US007334436B2

(12) United States Patent
Stingel et al.

(10) Patent No.: US 7,334,436 B2
(45) Date of Patent: Feb. 26, 2008

(54) COMPONENT FOR A KNITTING SYSTEM

(75) Inventors: Uwe Stingel, Messstetten (DE); Eckhard Fehrenbacher, Bondorf (DE); Manfred Sauter, Stetten a.k.M.-Storzingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/642,746

(22) Filed: Dec. 21, 2006

(65) Prior Publication Data

US 2007/0144220 A1 Jun. 28, 2007

(30) Foreign Application Priority Data

Dec. 23, 2005 (DE) ..... 10 2005 062 177

(51) Int. Cl.
*D04B 35/02* (2006.01)

(52) U.S. Cl. ..... 66/123

(58) Field of Classification Search ..... 66/116, 66/12, 121, 122, 123
See application file for complete search history.

(56) References Cited

U.S. PATENT DOCUMENTS

| | | | | |
|---|---|---|---|---|
| 1,681,512 A | * | 8/1928 | Beyer | 66/121 |
| 2,809,508 A | | 10/1957 | McDonough | |
| 3,712,083 A | | 1/1973 | Slof et al. | |
| 3,964,274 A | | 6/1976 | Stivers et al. | |
| 4,417,454 A | | 11/1983 | Berentzem | |
| 4,434,628 A | * | 3/1984 | Tsuzuki | 66/123 |
| 4,831,847 A | * | 5/1989 | Kawase et al. | 66/123 |
| 5,544,501 A | | 8/1996 | Hägel | |

FOREIGN PATENT DOCUMENTS

| | | |
|---|---|---|
| DE | 73 327 | 2/1893 |
| DE | 86 112 | 4/1896 |
| DE | 611 413 | 4/1935 |
| DE | 720 654 | 5/1942 |
| DE | 11 11 328 | 7/1961 |
| DE | 21 10 916 | 10/1971 |
| DE | 21 57 404 | 5/1973 |
| DE | 29 11 195 | 8/1980 |
| DE | 44 14 703 | 10/1995 |
| GB | 723 404 | 2/1955 |
| GB | 763 963 | 12/1956 |

* cited by examiner

*Primary Examiner*—Danny Worrell
(74) *Attorney, Agent, or Firm*—Norman N. Kuntz; Fitch, Even, Tabin & Flannery

(57) ABSTRACT

A system component (1) for a knitting system is composed of a body (3) with butt (18), which projects outward from the narrow side (16) of the body (3). According to a first advantageous embodiment of the invention, the butt (18) is positioned inclined or at an angle to the body (3). A corresponding bending line extends in longitudinal or movement direction of the body (3). The angle ($\alpha$) is thus defined in an imaginary plane (E) that intersects the body (3) in transverse direction. As a result of this measure, the butt (18) can also be adjusted relatively precisely at a right angle to the cam movement if the system component (1) along with it the body (3) is arranged somewhat inclined inside a corresponding guide slot (4) of a bed (5), wherein the angle $\alpha$ then compensates for the tilting. A line-type contact between the butt (18) and the guide track (7) is achieved, which reduces wear. Supplementary or alternatively thereto, the butt (18) is provided with thickened areas (29, 30) along its edges (19, 20), which also function to reduce wear.

20 Claims, 3 Drawing Sheets

COMPONENT FOR A KNITTING SYSTEM

CROSS REFERENCE TO RELATED APPLICATION

This application claims the priority of German Patent Application No. 10 2005 062 177.5-26 filed Dec. 23, 2005, the subject matter, in its entirety, is incorporated by reference.

BACKGROUND OF THE INVENTION

The invention relates to a component for a knitting system, for example knitting machine needle, a selection element, a coupling component, a transfer component, a holding-down part, a sinker, or a similar loop-forming component. In particular, the invention relates to a system component that executes a controlled movement relative to a cam assembly. The cam assembly is provided with a cam curve, along which glides an extension that projects away from the system component, called a butt, such that the system component moves inside a guide, corresponding to the shape of the cam curve. In particular, the invention relates to a system component for which the cam assembly and the bed, which holds the system component, move primarily or exclusively counter to each other in one direction, such as it the case mostly and primarily for circular knitting machines.

During the operation of a circular knitting machine, the butt glides along the cam curve of the cam and gradually wears down in dependence on such influencing factors as lubrication, contamination, hours of operation, machine speed, thread tension and the like. This is particularly true for the two edges of the butt, oriented transverse to the system component and the movement direction of same, which come in direct contact with the cam curve. In particular the edge facing the hook is subject to material erosion caused by wear, which can lead to a change in the effective operating length of the needle and thus to problems with the looping.

Various measures were taken in the past in an attempt to reduce the wear on the butt.

German Patent Document DE 21 57 404 A1 discloses a knitting machine needle having an elongated body with two flat sides and two narrow sides. During the operation, the body of the knitting needle body is positioned inside a guide slot of a needle bed, wherein the width to be measured between the flat sides of the body is considerably less than the slot width of the guide slot. The knitting machine needle has a butt projecting away from its narrow side and is twisted in longitudinal direction, wherein the direction of twisting is selected such that the butt is inclined relative to the movement direction. The section of the body or shank that is located between the butt and the working part of the knitting machine needle forms a torsion spring, which absorbs impacts against the butt by allowing the butt to carry out a springy swinging movement.

This solution requires a large play on the side between the guide slot defined in the needle bed and the knitting machine needle, wherein the width of the guide slot must be assumed to be preset. As a result, this proposal leads to extremely thin needles and correspondingly also to very narrow butts, which makes the hoped-for reduction in wear questionable.

German Patent Document DE 21 10 916 A1 discloses knitting machine needles, having a butt provided with an external part, which can be welded, glued, or soldered to the butt. The external part comes in contact with the cam assembly. The wear is therefore limited to this external part, the gliding surfaces of which can extend considerably past the edges of the butt.

Parts that are fitted onto the butt, however, represent a source of danger when they separate from the butt. In addition, they increase the knitting tool weight.

The same document also discloses butts in FIGS. 15 to 17, which are provided with an angled or bent-over section. This section projects outward from the butt in the manner of an exposed tongue and is bent around a line extending transverse to the longitudinal direction of the needle.

Needles of this type have not proven successful in practical operations.

German Patent Document DE 29 11 195 B1 discloses a knitting machine needle with a butt that is pressed to shape. Depressions are stamped into the butt parallel to the two edges, which are positioned transverse to the needle and serve to drive the needle. During the production, these depressions are used for the displacement of material, so that the adjoining edges can be smoothed. In many applications, these depressions in the butt have turned out to be locations of breakage and, on the whole, have resulted in only a limited improvement of the knitting machine needle.

SUMMARY OF THE INVENTION

Starting from the above background, it is the object of the present invention to create a system component for a knitting system which reduces the wear on the butt.

This object generally is solved according to a first aspect of the invention with a system component as defined in claim 1, and according to a second aspect of the invention with a knitting machine or automatic knitting machine according to claim 17:

The system component according to the invention is provided with a butt, which is designed to be driven by means of a cam assembly and is provided for this with at least one, preferably two, edges that extend away from the body of the system component and enclose an obtuse angle with at least one of the side surfaces. The "edge" is understood to be that narrow surface of the butt, which faces in or counter to the movement direction of the system component in its guide slot. As a result of the inclination of this edge relative to a plane predetermined by the side surface of the system component, the edge of the butt can make contact along a line-type or strip-shaped area over most of its length or, in the ideal case, the total length with the surface of the cam assembly. In particular, this avoids a point-shaped contact that may occur, as it has turned out, with the inventions according to prior art. As a result, the excessive material wear that otherwise occurs with the point-shaped contacts is avoided. The stress on the edge of the butt is evened out, thereby preventing the tearing or breaking of lubricating films, which are effective between butt and guide track.

The inclination of the butt relative to the side surfaces of the knitting tool permits a functional alignment of the butt and to retain this alignment, in particular also if the knitting tool is bent at an angle, caused by stress exerted from one side inside the guide slot, as is typically the case with circular knitting machines. That is to say, if the side surfaces are not oriented precisely parallel to the flanks of the guide slot. The obtuse angle between the butt and the side surface of the system components should preferably be large enough, so that it corresponds to the tilting or inclined positioning of the system component inside the guide slot and preferably compensates it so as to be straight. As a result, during the operation of the knitting machine, the needle butt projects vertically out of the needle slot, and the desired linear contact is generated between the cam track and the needle butt.

The above-mentioned object is furthermore solved with the system component according to claim 8, meaning by itself as well as in connection with the features disclosed in claim 1:

The system component according to the invention is provided with a cam assembly for driving the butt, wherein the butt is provided along its narrow sides with at least one rib-type thickened area extending away from the narrow side of the system component body, wherein this thickened area can be embodied in the manner of a bulge. The thickened area increases the area of contact between butt and the guide track of the cam assembly. Any wear is therefore stopped much faster than would be the case with butts not provided with such a thickened area. Even if an initial contact between the cam track and the edge of the butt is initially only between a point and a localized area, the material erosion occurring in this area is designed to increase the size of the area of contact, so that a line-type or strip-type contact is formed, thereby reducing the wear. This effect increases the wear resistance even with needles having a butt that is not bent at a right angle, meaning it extends along a single plane with the side surfaces. On the other hand, if the butt is somewhat inclined relative to this plane, the inclined position of the system component can additionally be compensated for inside the guide slot, so that the butt is positioned at a right angle to the relative movement direction and fits against the cam track, so as to move along a line.

The thickened area is advantageously formed with the aid of a plastic deformation process and can be a bulge projecting either from one flat side or both flat sides of the butt, wherein this bulge can extend on the side over the side surfaces of the system component. In addition to an improvement of the wear resistance, this also results in reinforcing the butt.

A depression can also be formed next to this thickened area, which can make the thickened area larger as a result of the material that is displaced when forming the depression.

The body of the system component is preferably not twisted. Its side surfaces thus fit completely against the flanks of the guide slot. A torque-bending or other resilient twisting of the body preferably should not be permitted, thereby ensuring the permanent, right-angle alignment of the butt.

Alternatively or complementary thereto, the compensation according to the invention of the slanted positioning of the butt for the system, resulting from the operation according to prior art, which compensation is achieved according to claim 1 through the system component design, can also be effected through measures taken on the knitting machine. For this, the guide slots in the needle bed can be arranged at an angle, such that the system components positioned at an angle therein are again aligned with butts parallel to the transverse direction of the guide slots of the cam assembly during the operation (meaning in forward turning direction) and thus make contact in a line with the cam track. In addition or alternative thereto, the cam track can also be provided with a slanted side position (inclination in transverse direction). An improvement over the prior art can already be achieved by limiting the aforementioned measure for the guide track to some regions of the aforementioned track.

Further details of advantageous embodiments of the invention are the subject matter of the claims, the drawing and/or the specification.

DETAILED DESCRIPTION OF THE DRAWINGS

Exemplary embodiments of the invention are illustrated in the drawing wherein.

DETAILED DESCRIPTION OF THE INVENTION

Figure 1:
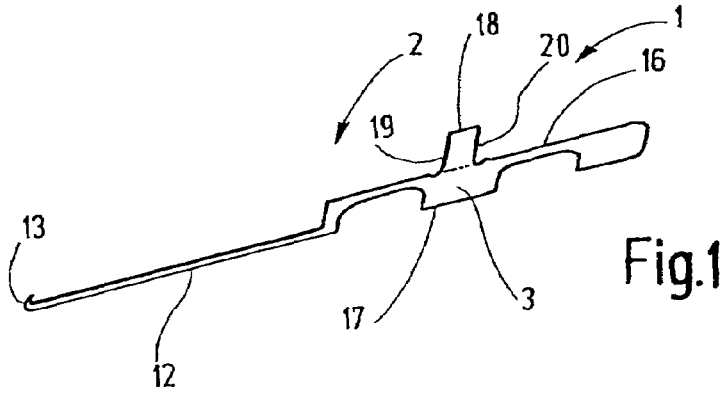
FIG. 1 is an illustration of a machine knitting needle belonging to a knitting system, shown in a schematic, perspective view.
Figure 2:
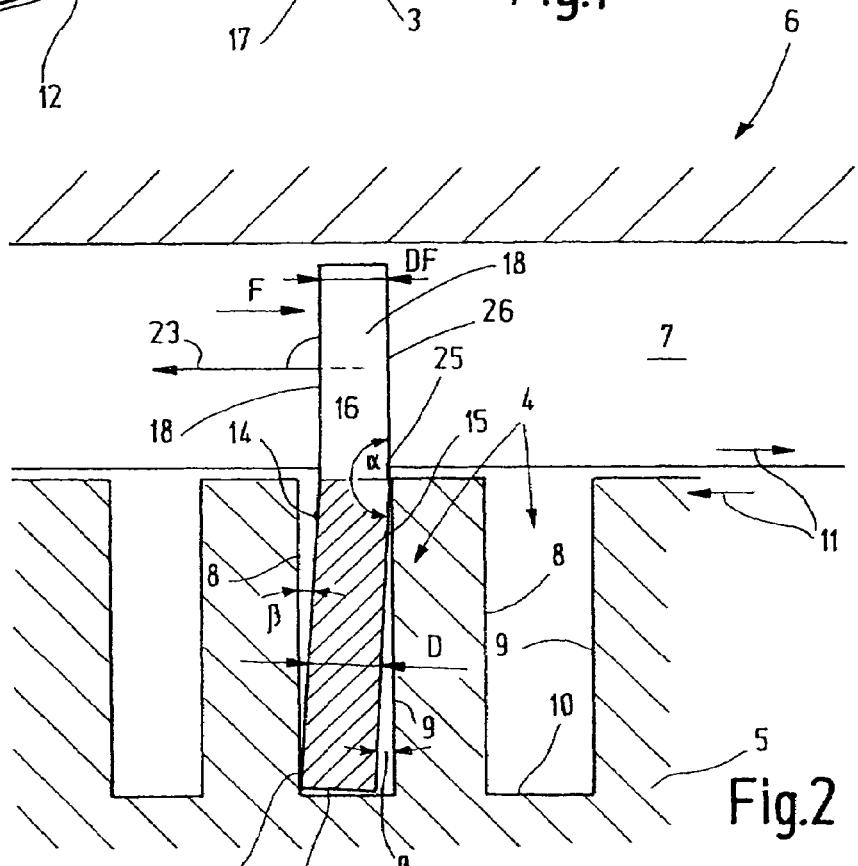
FIG. 2 is an illustration of the machine knitting needle according to FIG. 1, positioned inside a needle bed, in connection with a cam, shown in a schematic sectional view.

FIG. 1 shows a system component 1 in the form of a machine knitting needle 2 for a knitting system of a knitting machine that is not shown in further detail herein. The machine knitting needle 2 here simply functions to illustrate essential elements of the invention, which could also be realized on other movable parts of the knitting system, for example sinkers, coupling components, selection elements, transfer elements or similar components of a knitting system. The system component 1 has a body 3, embodied as flat, elongated body, which is arranged inside a guide slot 4 called a needle slot of a bed 5 when in use, as shown in FIG. 2. The needle bed 5 is a dial, for example, or a knitting cylinder of a circular knitting machine. In both cases, it has a large number of side-by-side arranged guide slots 4, which in the case of the knitting cylinder are arranged axially parallel to each other along the circumference. In the case of a dial, they are arranged radially. Assigned to the bed 5 and/or the knitting cylinder is a cam 6, which is provided with a guide track 7 for moving the system components 1 and/or the knitting machine needles 2, wherein these move inside the respective guide slot 4 in longitudinal slot direction, oriented perpendicular to the drawing plane according to FIG. 2. The guide slots 4 advantageously have a rectangular cross section and are delimited respectively by flat flanks 8, 9, positioned parallel to each other and enclose between them a bottom 10. Each of the guide slots 4 is provided with a system component that contributes to the loop formation, which is realized by the relative movement between the bed 5 and the cam 6. This relative movement is illustrated in FIG. 2 by an arrow pair 11 and is generated, for example, through a rotation of the bed 5, embodied as knitting cylinder, relative to the cam 6 in the idle position. The direction of the guide track 7 is a straight line, to be measured perpendicular to the bottom 10. For the circular knitting machine, this direction is the radial direction. In circumferential direction, designated in FIG. 2 by one of the arrows of the arrow pair 11, the guide track 7 has a profile, meaning a curvature, which determines the movement of the system component 1 and/or the machine knitting needle 2.

As shown in FIG. 1, the body 3 of the machine knitting needle 2 has a shank 12, which extends in needle movement direction or needle longitudinal direction and is provided with a hook 13 on its end, meaning the loop-forming region. Non-illustrated closing means, such as latches, closing elements or the like can be assigned to this hook. The body 3 is flat, as mentioned, and is provided with two flat side surfaces 14, 15. The distance between both side surfaces marks the width D of the body 3. The width D in that case is preferably less than the distance between the flanks 8, 9, so that the body 3 is positioned displaceable and with not too much play inside the guide slot 4. The body 3 is furthermore provided with narrow sides 16, 17 that connect the side surfaces 14, 15 and form the needle top and/or the needle back. The width of the narrow sides 16, 17 coincides with the width D and is substantially less than the height of the side surfaces 14, 15, measured at a right angle thereto. The height of body 3 is preferably dimensioned such that it fits completely inside the guide slot 4, as illustrated in FIG. 2. The narrow side 16 is thus positioned outside of the cam 6.

Figure 3:
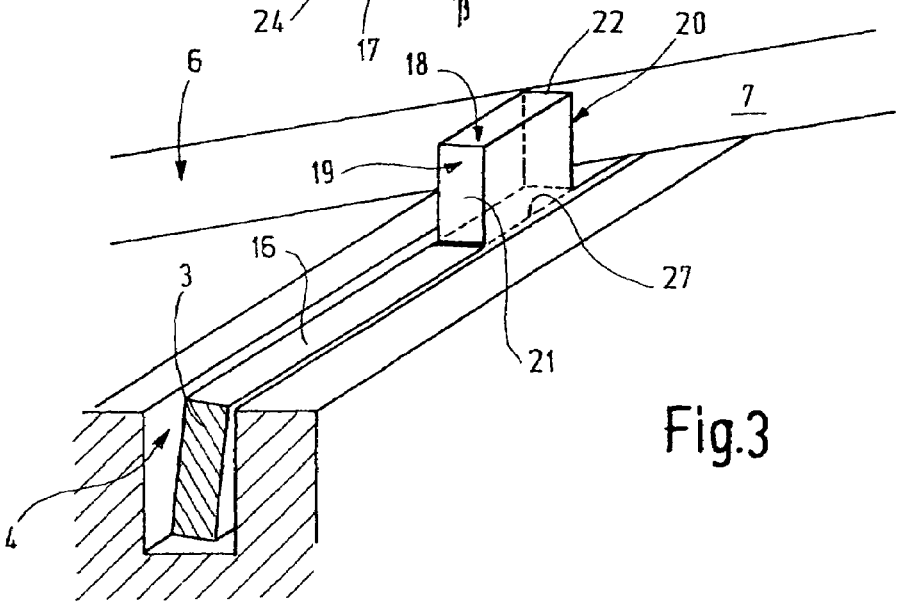
FIG. 3 is an illustration of the needle, the bed, and the cam according to FIG. 2, shown in a schematic, perspective sectional view.

A butt 18 extends away from the narrow side 16, which projects into the cam 6 and fits against the guide track 7. In a view from the side, the butt 18 is approximately rectangular in shape. Its front edge facing the hook 13, and its back edge facing away from the hook 13, the edges 19, 20, engage in the guide tracks of the cam 6. In FIG. 3, this is illustrated for the guide track 7 and the edge 20. The opposite-arranged edge 19 is also assigned to a guide track, wherein this track is not shown in FIG. 3.

Figure 4:
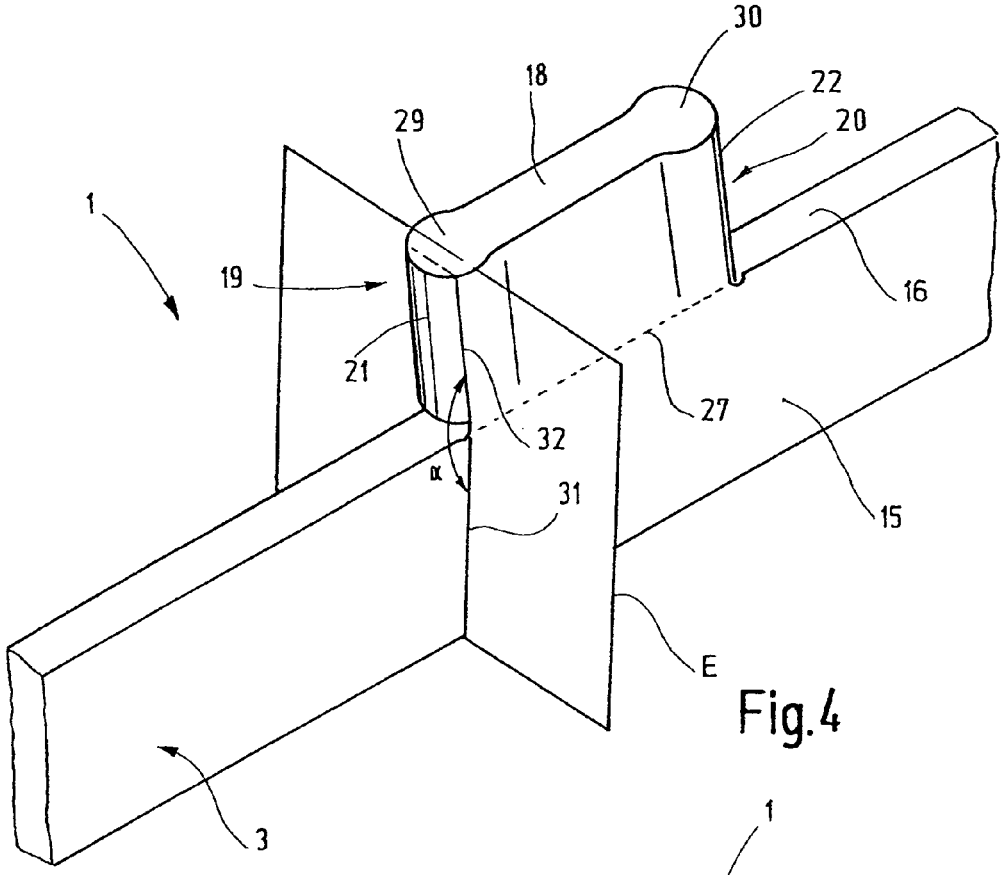
FIG. 4 is an illustration of a modified embodiment of the machine knitting needle according to FIGS. 1 and 2, shown in a schematic perspective view.

The edges 19, 20 are oriented at a right angle to the narrow side 16 and can be formed by flat or curved contact surfaces 21, 22, for example as shown in FIG. 4.

During the operation of a circular knitting machine, the knitting cylinder forming the bed 5 primarily or exclusively moves in one predetermined direction, for example as shown in FIG. 2 with the lower arrow of the arrow pair 11. Relative to the guide track 7, the butt 18 therefore moves in the direction of arrow 23. The butt 18 in the process glides along the guide track 7. The resulting frictional force F acts counter to the relative movement direction onto the butt 18 and, as shown, can effect a slanted positioning of the body 3 on the guide track 4. The slanted positioning means that the side surface 14, positioned in front with respect to the relative movement, fits against the flank 8 with its lower edge 24 that adjoins the narrow side 17. In contrast, the side surface 15, which is positioned in the back relative to the movement direction, fits against the flank 9 with its upper edge 25 that adjoins the narrow side 16. The slanted positioning of the body 3, relative to the radial direction of the knitting cylinder, can range from fractions of a degree to a few degrees.

The butt 18 of the system component 1 is inclined at an angle α counter to the body 3 in order to compensate for the slanted positioning of the body 3 inside the guide slot 4. The angle α must be measured between the side surface 15 and a side surface 26 of the butt 18. Its apex lies on a bending line 27, which is indicated with dashed line in FIG. 3 and is positioned perpendicular on the drawing plane in FIG. 2. This bending line 27 is oriented substantially parallel to the longitudinal direction of the guide slot 4 and/or the longitudinal direction of the system component 1, which coincides with its movement direction inside the guide slot 4. The bending line 27 is furthermore oriented parallel to the narrow side 16.

In the same way, the side surface 28 of the butt 18, which is positioned opposite the side surface 26, is inclined at the same angle, relative to the adjoining side surface 14. This angle α is dimensioned such that the side surface 26 and/or 28 is oriented at a right angle to the relative movement direction prescribed by the arrow 23. As a result of this measure, the edge 20 and/or the contact surface 22 makes contact along a line-type or strip-type area with the guide track 7, thereby avoiding in particular a point-type contact, which happens if the body 3 is somewhat tilted inside the guide slot 4, as shown in FIG. 2 or 3, and the butt 18 is aligned with the side surfaces of the body 3. Avoiding a point-type contact between the guide track 7 and the contact surface 22, results in distributing the load and reducing the wear on the guide track 7 as well as and especially on the butt 18.

Figure 5:
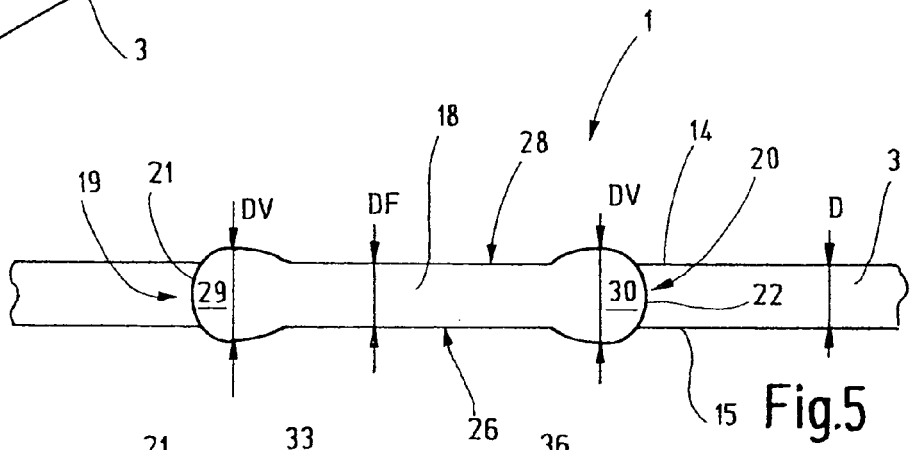
FIG. 5 is an illustration of a different, modified embodiment of the machine knitting needle, showing the butt in a view from above.

The side surfaces 26, 28 can be embodied as flat surfaces, as shown in the above, so that the width DF of the butt 18, which must be measured in the direction of arrow 23 between both side surfaces 26, 28, does not exceed anywhere the width D of the body 3. However, it is also possible to provide the butt 18 in particular in the region of its edges 19, 20 with a thickened area 29, 30, as shown in FIGS. 4 and 5. The thickened areas 29, 30 extend along the edges 19, 20 and are distinguished in that the butt 18 has a width DV in the thickened areas 29, 30, which exceeds the width D of the body 3. The width DV advantageously also exceeds the width DF of the butt 18, wherein both its side surfaces 26, 28 are then positioned flat and oriented parallel to each other outside of the thickened areas 29, 30. The thickened areas 29, 30 can be embodied symmetrical as well as asymmetrical, wherein they project only over one of the side surfaces 14, 15 in the asymmetrical case. In the preferred case, for example as shown in FIG. 5, they project over both side surfaces 14, 15.

According to FIG. 5, the system component 1, provided with a butt 18 as described, can have a flat design, so that the side surface 28 is arranged in a joint plane with the side surface 14 and the side surface 26 is arranged in a joint plane with the side surface 15. Alternatively, the width DF of the butt 18 can also exceed the widths D of the body 3. In that case, the side surfaces 26, 28 are oriented parallel to the side surfaces 14, 15.

In the case described so far, the butt 18 occupies a slanted position if the body 3 is somewhat tilted inside the guide slot 4, which initially results only in a sectional, rather point-type contact between the guide track 7 and the butt 18 and/or the corresponding contact surface 22. This leads to local wear of same, so that the contact surface 22 is somewhat deformed and the contact zone soon extends over the complete length of the butt 18, which extends at a right angle to the narrow side 16. In that case, the wear essentially stops and the function of the system component 1 is ensured.

According to one preferred embodiment, however, the butt 18 provided with thickened areas 29, 30 is tilted relative to the body 3, as shown in particular in FIG. 4. The bending line 27 is oriented in longitudinal direction and approximately parallel to the narrow side 16, as described in the above. An imagined intersecting plane E, which transversely bisects the body 3 in the region of butt 18, especially in the region of its edge 19 or 20, and for which the surface normal coincides with the longitudinal direction of body 3 and thus the movement direction for the system component 1 in the guide slot 4, intersects with the side surfaces 15 and the contact surface 21 along the intersecting lines 31, 32, which together enclose the above-explained angle α. The angle α is an obtuse angle, preferably close to 180°. To be precise, the angle should advantageously be 180°-β, wherein β here is an acute angle enclosed by the side surface 15 and the flank 9 and/or the side surface 14 and the flank 8. The angle β depends on the width of the guide slot 4 and the width D of the body 3, as well as the height of the slot. Additional influencing factors such as viscosity of the lubricant, operating speed of the knitting machine and so forth can also be important and could be a consideration for calculating α.

In principle, the idea behind the invention could also be realized by providing the angle of inclination a not on the knitting tool 1, but in the region of at least one flank 8, 9 of the guide slot 4. For example, since the needles 2 of a circular knitting machine are held with their body 3 pushed against the flanks 8, 9 of a guide slot 4 as a result of the rotational movement of the needle cylinder and/or the dial, it is generally sufficient to arrange only one of these flanks 8, 9 at an angle α. Depending on the type of knitting machine used and/or the manner in which the guide slot 4 is fashioned, however, both flanks 8, 9 of a guide slot 4 can be arranged at an angle.

Figure 7:
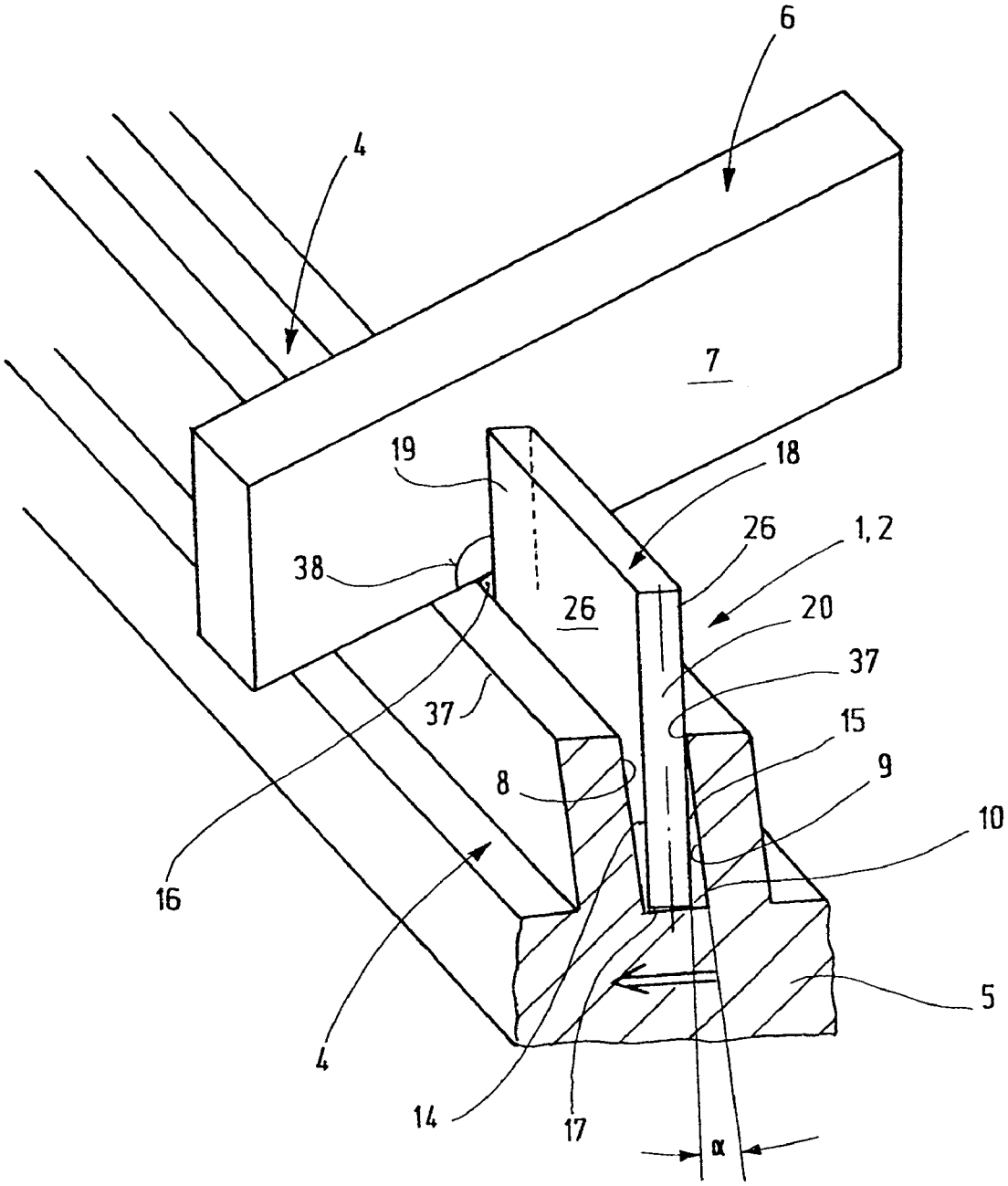

One example for embodying a knitting tool carrier according to the invention is shown with schematic detail in FIG. 7, wherein this carrier meets the same function with respect to the loop-forming as the knitting tool carrier corresponding to the needle bed 5 in FIG. 2. The guide slot which is delimited on the sides by the flanks 8, 9, accommodates a machine knitting needle 1, which can be embodied similar to the needle shown in FIG. 1 and is shown only schematically herein. The needle consists of a needle body 3 that is delimited in height by the narrow sides 16, 17 and in width by the side surfaces 14, 15. A butt 18 extends away from its narrow side 16 and projects into the cam 6, so that it fits against the guide track 7. Contrary to the preceding description, this machine knitting needle 2 is a traditional needle 2 for which the butt 18 and/or its edges 19, 20 are not arranged at an angle α to the side surfaces 14, 15 (α=180°). The side surfaces 14, 15 of the machine knitting needle 2 are arranged in a single plane with the side surfaces 26, 28 of the butt 18. The line-type or area-type contact between the edge 19, 20 and the guide track 7 of the cam 6 is achieved in that the guide slot 4, particularly its flanks 8, 9, are arranged at an angle α to the guide track 7. During the operation, the system component 1 is gripped by the guide track 7 of the knitting machine cam, thus resulting in a line-type and/or area-type contact between the edges 19, 20 of needle 2 and the cam curve 7. This is possible due to the angled arrangement of the guide slot 4, particularly because of the flank 9 that is slanted in movement direction of the bed 5, as shown in FIG. 7. In the process, the flank 9 is inclined by the angle α in movement direction. The edge 37, arranged opposite the bottom 10 on the side of flank 9, thus supports the needle 2 in the area of transition between body 3 and butt 18 and keeps it positioned perpendicular, relative to the guide track 7. The edge 19, 20 of butt 18 on the needle 2 is positioned parallel to an imagined plane (not drawn in) of the guide track 7 of cam 6. This alignment of the needle 2 relative to the guide track 7 is indicated at location 38 in FIG. 7. The angled arrangement of flank 9, 8 makes it possible to compensate for the play between the machine knitting needle 2 and the guide slot 4. As a result, it is possible to realize the inventive idea of achieving a line-type and/or area-type contact between a butt 18 and the guide track 7 of a cam 6 with the aid of and angled guide slot arrangement in a knitting machine.

It is also possible to position the guide track 7 of the knitting machine cam 6 at an angle (not drawn in), so that the edge 19, 20 of the butt 18 of a system component 1 is arranged parallel to the guide track 7, even though the guide slot 4 and/or its flank 8, 9 is not positioned at an angle and even though a system component 1 according to prior art is arranged in the guide slot 4 at the bending line 27, without being inclined as defined in the invention. To ensure parallelism between the inclined guide track 7 and the edge 19, 20 of system component 1, it is necessary to vary and adapt the angle of inclination of the guide track 7 for cam 6, relative to the cam angle and its ascending gradient within the cam curve. Even inclining some sections of the guide track 7 will result in a reduction in wear for the system component 1 and/or the drive means, meaning the butt 18 of the system component 1.

Figure 6:
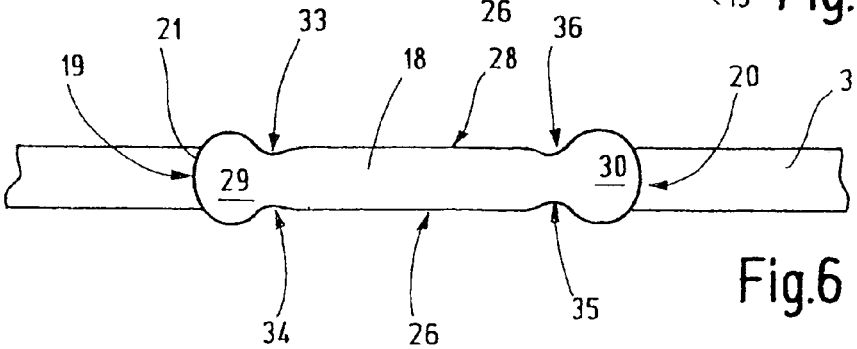
FIG. 6 is an illustration of a different embodiment of the machine knitting needle, showing a schematic view of the butt from above, and, FIG. 7 is an illustration of a modified embodiment of the invention, showing the needle, the bed, and the cam 2 in a schematic, sectional and perspective view.

The thickened areas 29, 30 are preferably realized by means of a plastic deformation process on the butt 18, which is obvious because they consist of the same material as the body 3 and the butt 18. Furthermore, no seams of any type, in particular no soldering or welding seams, advantageously exist between the body 3, the butt 18 and the thickened areas 29, 30. The seamless fiber progression of the material (preferably steel) is visible in the polished section. The plastic deformation can be such that the width DF coincides with the width D. Alternatively, the width DF can also be smaller than the width D, so as to cause a material displacement for filling in the thickened areas 29, 30 in a corresponding deformation cut. As shown in FIG. 6, one or several depressions 33, 34, 35, 36 can also be provided on the side surfaces 26, 28, preferably in the form of grooves running parallel to the edges 19, 20. These grooves make possible the material displacement for forming the bulge-type thickened areas 29, 30. Otherwise, the above description applies. According to FIG. 6, the butt 18 of this embodiment can also extend as a straight extension of the body 3, or at an angle thereto, as shown in FIG. 4.

A system component 1 for a knitting system is provided with a body 3 having a butt 18, which projects outward from the narrow side 16 of the body 3. The butt 18 of a first advantageous embodiment of the invention is inclined or angled relative to the body 3. A corresponding bending line extends in longitudinal or movement direction of the body 3. The angle α is therefore defined in an imaginary plane E that intersects in transverse direction with the body 3. As a result of this measure, the butt 18 can also be adjusted relatively precisely at a right angle to the cam movement, even if the system component 1 and along with it the body 3 is positioned somewhat tilted in a corresponding guide slot 4 of a bed 5. The angle α compensates for this tilted positioning, thereby resulting in a line-type contact between the butt 18 and the guide track 7, which reduces wear. To complement this or as an alternative thereto, the butt 18 is provided with thickened areas 29, 30 along the edges 19, 20, which also help reduce wear.

It will be appreciated that the above description of the present invention is susceptible to various modifications, changes and adaptations, and the same are intended to be comprehended within the meaning and range of equivalents of the appended claims.

REFERENCE NUMBER LIST

1 system component
2 machine knitting needle
3 body
4 guide slot

5 bed
6 cam
7 guide track
8, 9 flanks
10 bottom
11 arrow pair
12 shank
13 hook
14, 15 side surfaces
16, 17 narrow sides
18 butt
19, 20 edges
21, 22 contact surfaces
23 arrow
24, 25 edges
26 side surfaces
27 bending line
28 side surface
29, 30 thickened area
31, 32 intersecting lines
33, 34, 35, 36 depressions
37 edge
38 location
D, DV, DF width
E plane
F frictional sliding force

The invention claimed is:

1. A system component for a knitting system, with a body to be positioned inside a guide slot, wherein the body has a flat design, as well as two side surfaces and at least one narrow side, and with at least one butt for driving the system component by a cam, wherein the butt has at least one edge that extends away from the narrow side of the body and which, together with at least one side surface, encloses an obtuse angle (α) that is adapted to compensate for tilting of the system component within the guide slot resulting from operation of the component.

2. The system component according to claim 1, wherein the obtuse angle (α) exceeds 170° and is smaller than 180°.

3. The system component according to claim 1, wherein the angle (α) is dimensioned such that the at least one edge of the butt during the operation is oriented at a right angle to the direction of the relative movement between the cam and the needle bed.

4. The system component according to claim 1, wherein the butt is angled relative to the body at a bending line, which essentially extends at the height of the narrow side.

5. The system component according to claim 4, wherein the bending line is oriented parallel to the narrow side.

6. The system component according to claim 1, wherein the at least one edge of the butt is oriented at a right angle to the narrow side.

7. The system component according to claim 1, wherein the edge adjoins the narrow side.

8. A system component of a knitting system, with a body to be positioned inside a guide slot, wherein the body has two side surfaces, the spacing of which determines a width (D), and at least one narrow side, and with at least one butt for driving the system component by means of a cam, wherein the butt seamlessly adjoins the body, is integrally formed therewith, and has at least one integrally formed rib-type thickened area that extends away from the narrow side of the body.

9. The system component according to claim 8, wherein the thickened area has a width (DV), which is to be measured in the same direction as the width (D) and exceeds the width (D).

10. The system component according to claim 8, wherein the thickened area is a bulge, formed onto the butt by means of a plastic deformation.

11. The system component according to claim 8, wherein the butt is provided with two side surfaces that are positioned essentially parallel to each other and that the thickened area projects over the side of at least one of the side surfaces.

12. The system component according to claim 8, wherein at least one depression is formed in the butt next to the thickened area.

13. The system component according to claim 1, wherein the butt is provided with contact surfaces along the edges, which are designed to make contact with a guide track of a cam, so as to drive the system component in longitudinal direction.

14. The system component according to claim 13, wherein the contact surface forms an obtuse angle (α) with the side surfaces.

15. The system component according to claim 1, wherein the body is not twisted.

16. The system component according to claim 1, wherein the side surfaces are flat surfaces.

17. A knitting machine or automatic knitting machine, comprising at least one circular bed provided with a plurality of radially extending guide slots having respective system components positioned inside the guide slots, with the respective system components each having a flat shank that is disposed in a respective slot, has a thickness less than the width of the slot and that carries at least one butt, delimited by edges and extending out of the slot;

a cam provided with a guide track for moving the system component, which track is in contact with an edge of the butt of the system component during the movement; and wherein a sidewall of the butt forms an obtuse angle with a side wall of the shank such that the edge of the butt is arranged parallel to the guide track of the cam, so that the butt is in a line-type contact with the guide track during the relative operational movement between the bed and the cam.

18. The knitting machine or automatic knitting machine according to claim 17, wherein the angle (α) results from the play between the system component and guide slot.

19. The system component according to claim 8, wherein the butt is provided with contact surfaces along the edges, which are designed to make contact with a guide track of a cam, so as to drive the system component in a longitudinal direction.

20. The system component according to claim 19, wherein the contact surface forms an obtuse angle (α) with the side surfaces.

* * * * *